US009228148B2

(12) United States Patent
Hüffer et al.

(10) Patent No.: US 9,228,148 B2
(45) Date of Patent: Jan. 5, 2016

(54) METHOD FOR PRODUCING MOLDED BODIES FROM SHEET STEEL GALVANIZED ON ONE OR BOTH SIDES

(75) Inventors: Stephan Hüffer, München (DE); Helmut Witteler, Wachenheim (DE); Achim Feβenbecker, Waghäusel (DE); Karl-Heinz Stellnberger, Linz (AT); Martin Fleischanderl, Rainbach Im Mühlkreis (AT)

(73) Assignee: Voestalpine Stahl GmbH (AT)

( * ) Notice: Subject to any disclaimer, the term of this patent is extended or adjusted under 35 U.S.C. 154(b) by 1072 days.

(21) Appl. No.: 13/133,064

(22) PCT Filed: Nov. 24, 2009

(86) PCT No.: PCT/EP2009/065753

§ 371 (c)(1),
(2), (4) Date: Feb. 15, 2012

(87) PCT Pub. No.: WO2010/063618

PCT Pub. Date: Jun. 10, 2010

(65) Prior Publication Data

US 2012/0164474 A1 Jun. 28, 2012

(30) Foreign Application Priority Data

Dec. 4, 2008 (EP) ..... 08170658

(51) Int. Cl.
*B23P 13/02* (2006.01)
*C10M 105/74* (2006.01)

(52) U.S. Cl.
CPC ..... *C10M 105/74* (2013.01); *C10M 2223/04* (2013.01); *C10M 2223/042* (2013.01); *C10M 2223/043* (2013.01); *C10N 2230/12* (2013.01); *C10N 2240/40* (2013.01);
(Continued)

(58) Field of Classification Search
CPC ..... B21C 9/00; B21C 37/02; B23P 13/02; B23D 79/00; B23D 2277/60; B21D 53/88; Y10T 29/45; Y10T 29/49789; Y10T 29/49798; Y10T 29/49995
See application file for complete search history.

(56) References Cited

U.S. PATENT DOCUMENTS 4,360,474 A 11/1982 Brady et al.
4,684,475 A 8/1987 Matulewicz
(Continued)

FOREIGN PATENT DOCUMENTS

DE 2756747 A1 6/1979
EP 2530 A1 * 6/1979
(Continued)

OTHER PUBLICATIONS

Machine translation of EP 2530 A1, retrieved Nov. 25, 2014.*
(Continued)

*Primary Examiner* — Christopher Besler
(74) *Attorney, Agent, or Firm* — Drinker Biddle & Reath LLP

(57) ABSTRACT

A method of producing shaped articles made from single-sidedly or double-sidedly galvanized steel sheet, starting from galvanized steel strip, at least one of the steps of the method being a transport operation, and in which, for protection from black-spot corrosion, a corrosion preventive oil is applied which comprises at least one phosphoric acid polyoxyalkylene ester.

10 Claims, 2 Drawing Sheets

(52) U.S. Cl.
CPC ..... *C10N 2240/409* (2013.01); *Y10T 29/45* (2015.01); *Y10T 29/49789* (2015.01); *Y10T 428/12556* (2015.01)

(56) References Cited

U.S. PATENT DOCUMENTS

| | | | | |
|---|---|---|---|---|
| 5,104,026 | A * | 4/1992 | Sturrus et al. | 228/17.5 |
| 5,555,756 | A * | 9/1996 | Fischer et al. | 72/41 |
| 6,602,833 | B1 * | 8/2003 | Skold | 508/423 |
| 2005/0227877 | A1 * | 10/2005 | Wo et al. | 508/345 |

FOREIGN PATENT DOCUMENTS

| | | | |
|---|---|---|---|
| EP | 378246 | A1 * | 7/1990 |
| WO | WO-00/42135 | A1 | 7/2000 |

OTHER PUBLICATIONS

International Preliminary Report on Patentability for PCT/EP2009/065753 dated Jun. 16, 2011.

Translation of the International Preliminary Report on Patentability for PCT/EP2009/065753 dated Jun. 16, 2011.

* cited by examiner

METHOD FOR PRODUCING MOLDED BODIES FROM SHEET STEEL GALVANIZED ON ONE OR BOTH SIDES

CROSS-REFERENCE TO RELATED APPLICATIONS

This application is a national stage application (under 35 U.S.C. §371) of PCT/EP2009/065753, filed Nov. 24, 2009, which claims benefit of European application 08170658.2 filed Dec. 4, 2008.

BACKGROUND OF THE INVENTION

The present invention relates to a method of producing shaped articles made from single-sidedly or double-sidedly galvanized steel sheet, starting from galvanized steel strip, at least one of the steps of the method being a transport operation, and in which, for protection from black-spot corrosion, a corrosion preventive oil is applied which comprises at least one phosphoric acid polyoxyalkylene ester.

The production of flat metallic ready-made products from galvanized steel, such as automobile bodies or parts thereof, appliance casings, exterior architectural facings, ceiling panels or window profiles, for example, is a multi-stage operation. The raw materials for it are usually galvanized steel strips which are produced by rolling of the metal, followed by galvanizing, and which for storage and transportation are wound to form rolls (referred to as coils). For processing, these coils are wound again, separated into smaller pieces, and shaped by means of suitable techniques such as punching, drilling, folding, profiling and/or deep-drawing. Larger components, such as automobile bodies, for example, are optionally obtained by the joining of two or more individual parts. After shaping and joining have taken place, the product can be painted, for example.

A characteristic of the stated production operation is that not all of the steps referred to are performed in one manufacturing site; instead, as a general rule, precursor products and/or semifinished products must be transported one or more times from one manufacturing site to another. To take as an example the production of automobiles: the production of the metal strips takes place at the premises of a steelmaker. The cutting-up of the strips and the shaping to an automobile body or bodywork parts takes place in a pressing plant, and the manufactured bodies or parts thereof are then transported to an automaker for painting and final assembly.

Also deserving of mention in this context is the "completely knocked down" or "partly knocked down" manufacturing technique for automobiles, where vehicles intended for export are transported deliberately not in the fully assembled state but instead in the form of individual parts to the importing country, and undergo final assembly only in that importing country. With this manufacturing technique, entire bodies or bodywork parts must be transported form the exporting to the importing country, in some instances in ocean voyages that can take several weeks.

In the course of transport, on railroad wagons or in ships, for example, the precursor products and/or semifinished products are subject to atmospheric influences, and must therefore be protected from corrosion for their transport.

For corrosion protection in transport, it is common to apply what is called a "temporary protective"; in other words, this is not yet the final corrosion preventive coating, which is intended to impart permanent protection to the finished product, but is instead a coating which is removed at a later point in the process and replaced by the ultimate corrosion preventive coating. For temporary protection from corrosion, the steel strips are provided generally with a coating of a corrosion, preventive oil. Corrosion preventive oils often have a dual function and also act as forming auxiliaries, as during deep-drawing, for example. The forming oil is intended to ensure the necessary lubricity during the shaping operation, so as to prevent fracture or rupture of the metal sheet.

In the transport of shaped articles made from galvanized steel, one specific form of corrosion comes to the fore, namely that known as black-spot corrosion. This is a locally confined, rather than an extensive, form of corrosion. One possible cause of this black-spot corrosion is the possibility of contamination of the metal surfaces by particles in the course of transport. This particulate contamination then leads frequently to very locally confined forms of corrosion around the particles. The particles in question may for example be particles of dirt and/or of salt, or may be particles of salt in association with dirt.

Especially in the case of electrolytically galvanized steel, this form of corrosion also results in a significant change in the surface morphology. Viewed from the side, the metal surface is seen to have, for example, craterlike elevations. In the context of automobile construction, craterlike elevations of this kind are extremely disruptive, since they tend to be exacerbated, and certainly not leveled out, by the subsequent cationic deposition coating process. As a result of the black-spot corrosion, extremely extensive afterwork is necessary on the assembled body. This afterwork not only leads to high costs for the automaker but also disrupts the time course of the line manufacturing operation. Furthermore, the corrosion resistance of the completed body is adversely affected as well, since remediated spots constitute nucleation cells for the corrosion of the consumer product.

The use of phosphoric esters with alkoxy groups as corrosion inhibitors is known.

DE 27 56 747 A1 discloses the use of phosphoric esters, obtainable by reaction of phosphoric acids with alkoxylated polyols, such as polypropylene glycol, as low-foam corrosion-control and lubricant compositions.

U.S. Pat. No. 4,360,474 discloses derivatives of polyphosphoric monoesters and also their use as corrosion inhibitors, the ester groups being polyalkylene groups.

U.S. Pat. No. 4,684,475 discloses a radiator protection mixture which besides other components comprises an organophosphate comprising alkylene oxides as a corrosion inhibitor.

WO 00/42135 discloses the machining of metals using metalworking fluids which comprise phosphoric esters comprising oxyalkylene groups.

U.S. Pat. No. 5,555,756 discloses a method for improving the stretchability of a steel strip. For this method, the steel strip is first heated and then a liquid lubricant is applied to the surface and is subsequently dried, forming a dry film on the surface. The quantity applied is at least 10.8 mg/m$^2$. The steel strip is subsequently rolled. The liquid lubricant comprises preferably water, a surfactant, and an alkyl phosphate ester of the general formulae RO—P(=O)(OH)$_2$ or (RO)$_2$—P(=O)OH, with R being an alkyl group having 4 to 20 carbon atoms. Phosphoric esters formed from alkoxylated alcohols are not disclosed.

None of the stated specifications, however, is concerned with the problem of black-spot corrosion in the transport of precursor products or semifinished or finished products of galvanized steel in an atmospheric environment.

BRIEF SUMMARY OF THE INVENTION

It was an object of the invention to provide improved corrosion protection for the transport of precursor products and semifinished or finished products made from galvanized steel, allowing effective prevention of salt-grain or black-spot corrosion.

In a first aspect of the invention, a temporary corrosion preventive coating for galvanized steel has been found which comprises phosphoric acid polyoxyalkylene esters and which is especially suitable for preventing black-spot corrosion in the transport of precursor products and semifinished or finished products made from galvanized steel.

Accordingly a method has been found of producing shaped articles made from single-sidedly or double-sidedly galvanized steel sheet, said method comprising—in this order—at least the following steps:

(1) applying a corrosion preventive oil to the surface of a galvanized steel strip in an amount of 0.25 to 5 g/m$^2$, (2) transporting the coated, galvanized steel strip to a fabrication site for shaped articles, and (3) separating and forming the galvanized steel strip into shaped articles made from single-sidedly or double-sidedly galvanized steel sheet, wherein the corrosion preventive oil comprises 20 to 100% by weight, based on the total amount of all of the components of the corrosion preventive oil, of at least one phosphoric ester (A) of the general formula $$[R^2—(—O—CH(R^1)—CH_2—)_n—O—]_k—P(=O)—(OX)_{3-k}$$

and where $R^1$, $R^2$, X, n, and k have the following definitions:

k: 1 or 2, n: a number from 10 to 70, $R^1$: independently at each occurrence a radical selected from the group consisting of H, $C_1$ to $C_{10}$ alkyl radicals or aryl-substituted $C_2$ to $C_{10}$ alkyl radicals, with the proviso that for at least 50 mol % of the radicals $R^1$ is a methyl radical, $R^2$: H or a $C_1$ to $C_{30}$ alkyl radical, X: H or a cation $1/mY^{m+}$, where m is a natural number from 1 to 3.

Also found has been a shaped, galvanized steel article having a corrosion preventive coating of this kind. In one preferred embodiment of the invention the shaped articles comprise parts of automobile bodies or comprise automobile bodies.

This solution was particularly surprising because polyoxyalkylene phosphoric esters are commercially available corrosion inhibitors whose use for a very wide variety of purposes is already known. Nevertheless, compounds of this kind have not hitherto been proposed for preventing black-spot corrosion in the course of the transport of shaped articles made from galvanized steel.

DETAILED DESCRIPTION OF THE INVENTION

Figure 2:
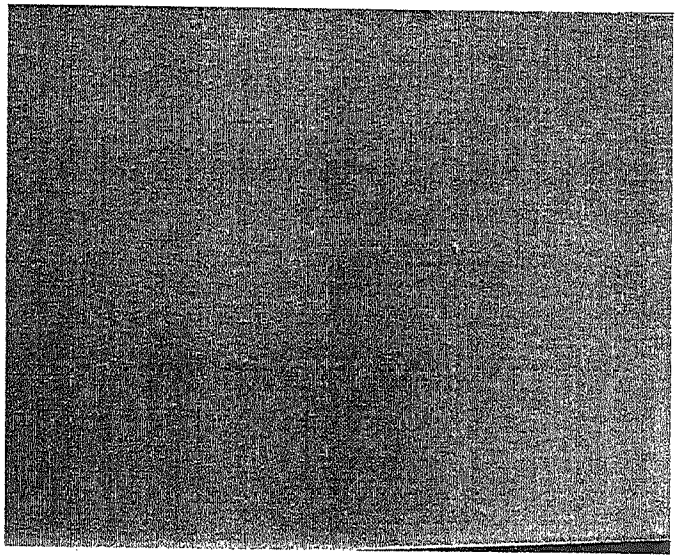
FIG. 2, in contrast, shows a photograph of the metal sheet coated with the corrosion preventive oil of the invention, after an experimental duration of 96 hours.

Details of the invention now follow.

Test Method

With the known salt spray tests for determining the corrosion resistance of metal sheets, the entire surface of the test sheet is subjected to a fine mist of salt-containing water; in other words, it involves uniform corrosive exposure of the entire metal surface.

In the method developed in accordance with the invention for testing galvanized steel sheets for their resistance to black-spot corrosion, in contrast, the uniform corrosive exposure is replaced by a pointwise corrosive exposure.

For the conduct of the test, the galvanized steel sheets for testing are stored horizontally in a controlled-climate chamber. For the test, the galvanized steel sheets are coated with the test coating, though for purposes of comparison it is of course also possible to test uncoated sheets. Typical test sheets have a surface area of approximately 0.01 m$^2$, though it is of course also possible to use test sheets with other surface areas. Generally speaking, however, the size should not be below 0.0025 m$^2$.

For the conduct of the test, the facing side of the sheets is sprinkled with salt-containing test particles. These particles may in the simplest case be salt grains, especially NaCl grains, though it is also conceivable to use test particles of other materials, such as of NaCl-contaminated sand, for example, in order to allow better modeling of dirt particles. The particles may of course also be agglomerates of smaller particles. Generally speaking the particles ought to have a diameter of 0.1 to 1 mm, preferably 0.2 to 0.6 mm. Corresponding particle fractions can easily be provided by sieving. In this test the surface is sprinkled in such a way that the particles are arranged essentially each individually on the surface. The amount of particles ought in general to be 1000 to 25 000 particles/m$^2$, preferably 5000 to 15 000 particles/m$^2$, and, for example, about 10 000 particles/m$^2$; thus, for a sheet size of 1 dm$^2$, approximately 100 particles.

The sheets thus treated are then stored for a defined time at defined humidity and temperature in a suitable apparatus for setting the climatic conditions. The test is carried out preferably at 15 to 40° C., more preferably at room temperature, although other test temperatures are of course also conceivable. A relative humidity of 60% to 90%, 85% for example, and a test time of 12 to 96 h, 24 h for example, have proven suitable. Other test times are of course also conceivable. In particular it is also possible to study the corrosion over the course of time. The test conditions can be adapted by the skilled worker, for example, to the climatic conditions that prevail in the course of transport.

After the respective test time has elapsed, the surface of the sheet is inspected for corrosion around the test particles. The evaluation may in particular be made photographically. Evaluation parameters may include the number of black spots that have appeared on the sheet, and also the respective size of the corroded areas around the test particles. It is additionally possible to record the time profile of the corrosion. For example, it is possible to record when black spots are first observed, or to record the number of black spots as a function of time.

The test according to the invention allows the corrosion behavior of galvanized shaped articles in the course of transport operations to be assessed in a more realistic way than with the known salt spray tests.

Thus, for example, the testing of the inventively used corrosion preventive oil with the inhibitor (A) by means of a salt spray test produced only moderate results and so this inhibitor, on the basis of the salt spray test, would not have been contemplated for the present application. Only the test developed in accordance with the invention revealed the particular suitability of the corrosion inhibitor (A) in preventing black-spot corrosion.

Corrosion Preventive Oil Used

In accordance with the invention a corrosion preventive oil is applied to the metal surface of single-sidedly or double-sidedly galvanized steel sheet for protection against black-spot corrosion in the course of the storage and transport of said sheet metal, the corrosion preventive oil comprising 20 to 100% by weight of at least one phosphoric acid polyoxyalkylene ester (A). This quantity figure is based on the total amount of all of the components of the corrosion preventive oil. Furthermore, the corrosion preventive oil preferably comprises a diluent in a quantity of up to 80% by weight relative to all of the components of the corrosion preventive oil, and may additionally comprise further components. These include typical additives and adjuvants of corrosion preventive oils.

The phosphoric acid polyoxyalkylene esters used have the general formula (I)

$$[R^2—(—O—CH(R^1)—CH_2—)_n—O—]_k—P(=O)—(OX)_{3-k} \quad (I).$$

The radicals $R^1$ in this formula are independently at each occurrence a radical selected from the group consisting of H, $C_1$ to $C_{10}$ alkyl radicals or aryl-substituted $C_2$ to $C_{10}$ alkyl radicals, with the proviso that for at least 50 mol % of the radicals $R^1$ is a methyl radical.

Examples of $C_1$ to $C_{10}$ alkyl radicals comprise methyl, ethyl, 1-propyl, 1-butyl, 1-pentyl, 1-hexyl or 1-octyl radicals. Examples of aryl-substituted $C_2$ to $C_{10}$ alkyl radicals comprise 2-arylethyl radicals, especially 2-phenylethyl radicals. $R^1$ preferably comprises radicals selected from the group consisting of H, methyl radicals or ethyl radicals, i.e., the polyoxyalkylene block comprises blocks based on ethylene oxide, propylene oxide or butylene oxide units. Preferably at least 60 mol %, more preferably at least 80 mol %, and very preferably at least 95 mol % of the radicals $R^1$ comprise a methyl radical. $R^1$ may of course also exclusively comprise methyl radicals.

The radical $R^2$ is H or a straight-chain or branched $C_1$ to $C_{30}$ alkyl radical. In the case of alkyl radicals, those concerned are preferably straight-chain or branched $C_1$ to $C_6$ alkyl radicals and more preferably methyl or ethyl radicals.

Preferably $R^2$ is H.

The number n is a number from 10 to 70. The person skilled in the art of alkoxylation is aware that these numbers represent average values. Preferably n is 20 to 60 and more preferably 25 to 40.

Where the polyoxyalkylene blocks have different radicals $R^1$, the different alkylene oxide units may be incorporated randomly in the block, or the copolymers in question may be block copolymers or gradient copolymers. The person skilled in the art of alkoxylation is likewise aware that the orientation in which an alkylene oxide unit is incorporated into a polyoxyalkylene oxide chain may be dependent on the reaction conditions; the formula above is therefore, intended to comprise structures of the type $R^2—(—O—CH(R^1)—CH_2)_n—O—$ and also $R^2—(—O—CH_2—CH(R^1)—)_n—O—$.

X is H or is a cation $1/mY^{m\pm}$, where m is a natural number from 1 to 3, i.e., the compound in question may be an acidic ester or a salt thereof. It is of course also possible for two or more different radicals X to be involved.

The cations $Y^{m+}$ may be alkali metal ions, such as $Li^+$, $Na^+$ or $K^+$, for example, or alkaline earth metal ions or ammonium ions. Ammonium ions include $NH_4^+$ and ammonium ions $[NR^4_4]^+$ containing organic radicals, the radicals $R^4$ each independently of one another being H or hydrocarbon radicals, more particularly hydrocarbon radicals having 1 to 20 carbon atoms, and it also being possible for the radicals to be substituted further. Mention is made in particular of ammonium ions derived from di- or triethanolamine and also from fatty amines.

Preferably X is H, i.e., the phosphoric esters are preferably used in the acid form.

The number k may have the value of 1 or 2, i.e., the esters are phosphoric monoesters or phosphoric diesters. Preferably k has the value 1.

The phosphoric acid polyoxyalkylene esters described may be prepared in a way which is known in principle, by esterifying alcohols of the general formula $R^2—(—O—CH(R^1)—CH_2—)_n—OH$ with phosphoric acids or phosphorus pentoxide. Advantageously for this purpose it is possible to use polyphosphoric acid, which is able to bind water formed in the course of the esterification. Once suitable method of preparation is described in DE 27 56 747 A1, for example. The reaction generally produces a mixture of monoesters and diesters, whereas triesters are generally not formed. Preferred mixtures for the performance of the invention are those in which the monoesters are present in an amount of at least 80 mol % relative to the amount of all of the esters. As secondary components the reaction mixtures may further comprise residues of phosphoric acid and/or polyphosphoric acid, and also, if appropriate, other products as well. For the case of $R^2$=H, for example, it is possible for diesters of the formula $(OH)_2R(=O)—(—O—CH(R^1)—CH_2—)_n—O—P(=O)(OH)_2$ to be formed. Secondary components of this kind may be separated off prior to use; generally, however, it is possible to use the unpurified products directly in the method of the invention.

It will be appreciated that mixtures of two or more different phosphoric acid polyoxyalkylene esters (I) can also be used. The amount of the phosphoric acid polyoxyalkylene esters (I) is 20 to 100% by weight, relative to the amount of all of the components of the corrosion preventive oil, preferably 25 to 80% by weight, more preferably 30 to 70% by weight, and very preferably 30 to 60% by weight.

Besides the phosphoric acid polyoxyalkylene esters (A) the corrosion preventive oil may further comprise at least one diluent (B). Diluents can be used to adjust the viscosity of the corrosion preventive oil to the desired value, thereby allowing optimum processing. There is no restriction on the selection of diluents, provided they are miscible with the phosphoric acid polyoxyalkylene esters (A). Suitability is possessed in particular by organic solvents which have a certain polarity, whereas water or nonpolar organic solvents such as hydrocarbons ought not to be used. Suitable diluents comprise oxygen-containing organic solvents, more particularly those which comprise ether functions and/or alcohol functions.

Suitable diluents comprise, in particular, oligo- and polyoxyalkanediols and/or the corresponding etherified products such as, for example, di-, tri-, tetra-, oligo-, and polypropylene glycols. Preference is given to diluents (B) of the general formula $R^3—(—O—CH(CH_3)—CH_2—)_m—O—R^3$ (II), where the radicals $R^3$ independently at each occurrence are H or a $C_1$ to $C_4$ alkyl radical, preferably H or methyl, and more preferably H. The radical m in formula (If) stands for a number from 2 to 20, preferably 2 to 12, and more preferably 2 to 5. Dipropylene glycol is particularly suitable as diluent.

The amount of all of the diluents (B) used is together up to 80% by weight, preferably 20 to 75%, and more preferably 30 to 70%, and very preferably 40 to 70%, by weight, based in each case on the total amount of all of the components of the formulation employed.

The corrosion preventive oil used in accordance with the invention may optionally further comprise additives or auxiliaries (C). Adjuvants of this kind can be used to adapt the properties of the oil to the desired purpose.

Examples of such additives (C) comprise carboxylic esters, free or partly neutralized carboxylic acids, emulsifiers, such as alkylsulfonates, for example, or antioxidants such as phenolic components, imidazoles, polyether phosphates, alkyl phosphates or succinimides, especially polyisobutylenesuccinimides reacted with oligoamines such as tetraethylenepentamine and/or ethanolamines. Additionally it is also possible to use phosphoric or phosphonic esters, or else antiwear additives, such as zinc dithiophosphate, for example. The skilled person makes an appropriate selection from the additives in accordance with the desired properties of the formulation.

The amount of all of the additives and auxiliaries used is together 0% to 30%, preferably 0% to 20%, more preferably 0.5% to 20%, and very preferably 1% to 10%, by weight, based in each case on the total amount of all of the components of the formulation employed.

In one preferred embodiment of the invention it is possible to use 20 to 80% by weight of the phosphoric acid polyoxyalkylene ester (A) in a mixture with 80 to 20% by weight of a diluent (B) of the general formula (II), preferably 30 to 70% by weight of (A) in a mixture of 70 to 30% by weight of (B) of the formula (II), the sum of (A) and (B) relative to the sum of all of the components of such a mixture being at least 80% by weight, preferably at least 90% by weight, and more preferably 100% by weight.

For use, components (A) and also, optionally (B) and/or (C) are mixed together.

In accordance with the invention, the described corrosion preventive oil is used for corrosion prevention in the course of the storage and/or transport of shaped articles made from galvanized steel sheet. The steel sheets typically have a thickness of 0.2 to 3 mm. The steel sheet may be single-sidedly or double-sidedly galvanized.

The term "galvanized" also, of course, comprises steel sheets coated with Zn alloys. These may be steel strips which are hot-dip galvanized or electrolytically galvanized. Zn alloys for coating steel are known to the skilled worker. Depending on the desired application, the skilled worker selects the nature and amount of alloying constituents. Typical constituents of zinc alloys comprise, in particular, Al, Mg, Si, Sn, Mn, Ni, Co, and Cr, preferably Al or Mg. There may also be Al/Zn alloys in which Al and Zn are present in approximately the same amount. The coatings may be largely homogeneous coatings or else coatings with concentration gradients. With further preference the alloys may be Zn/Mg alloys. The steel in question may be a steel coated with a Zn/Mg alloy, such as a hot-dip galvanized steel, for example, or may be a galvanized steel additionally vapor-coated with Mg. In this way it is possible to produce a Zn/Mg alloy at the surface.

The shaped articles include, in particular, those articles which can be used for lining, masking or cladding. Examples comprise automobile bodies or parts thereof, truck bodies, frames for two-wheeled vehicles such as motorcycles or bicycles, or parts for vehicles of this kind, such as fairings or panels, casings for household appliances such as washing machines, dishwashers, laundry driers, gas and electric ovens, microwave ovens, chest freezers or refrigerators, casings for industrial appliances or installations such as, for example, machines, switching cabinets, computer housings or the like, structural elements in the architectural sector, such as wall parts, facing elements, ceiling elements, window profiles, door profiles or partitions, furniture made from metallic materials, such as metal cupboards, metal shelving, furniture parts or else fittings. The articles may also be hollow articles for the storage of liquids or other substances, such as, for example, tins, cans or tanks. The term "shaped article" also comprises precursor products in the manufacture of the stated materials, such as steel strips or steel sheets, for example.

Use is performed by applying the corrosion preventive oil, prior to storage and/or to transport, to the galvanized surface, in an amount of 0.25 to 5 g/m$^2$, preferably 0.5 to 3 g/m$^2$, and more preferably 1 to 2.5 g/m$^2$.

"Transport" here refers to all kinds of transport operations in which the shaped articles are moved from one location to another location. The first location may in particular be the site of fabrication of the shaped articles, but may alternatively be a temporary storage facility. The second location is in particular another fabrication site, at which the shaped articles obtained are subjected to further processing. For example, the first location may be a pressing plant where automobile bodies or bodywork parts are manufactured, and the second location may be an automobile assembly facility.

"Storage" refers to all kinds of storage operations. This may involve brief temporary storage of several hours to several days, or else a longer storage of several weeks to several months.

Method of Producing Shaped Articles

In one preferred embodiment of the method, the corrosion preventive oil is used by means of the method of the invention as described below, in which shaped articles made from single-sidedly or double-sidedly galvanized steel sheet are produced.

Starting material used for the method of the invention comprises galvanized steel strips. Galvanized steel strips typically have a thickness of 0.2 to 3 mm and a width of 0.5 to 2.5 m. Galvanized steel strips are available commercially for a very wide variety of applications. They may be single-sidedly or double-sidedly galvanized steel strips. The skilled worker selects a suitable steel strip in accordance with the desired end use.

The term "galvanized" also, of course, comprises steel strips coated with Zn alloys. Suitable zinc alloys have already been described.

Step (1) of the Method

In step (1) of the method the above-described corrosion preventive oil is applied to the surface of the galvanized steel strip. Where the strip is a single-sidedly galvanized strip, the formulation used in accordance with the invention is applied at least to the galvanized side, but may of course also be applied to the ungalvanized side. The ungalvanized side may also, however, be treated with a different corrosion preventive oil.

Application may take place, for example, by spraying, including in particular by spraying with assistance from an electrostatic field. Moreover, application may be made using a Chemcoater or else by immersion in an oil bath, followed by squeezing off, or, alternatively, by spraying of the oil on to the metal sheet, followed by squeezing off.

The amount of the corrosion preventive oil applied to the surface is generally 0.25 to 5 g/m$^2$, preferably 0.5 to 3 g/m$^2$, and more preferably 1 to 2.5 g/m$^2$.

The corrosion preventive oil may be applied preferably immediately after the steel strip has been produced, in other words, typically, in a steel plant or rolling plant. This, however, does not rule out the application of the corrosion preventive oil only at a later point in time.

The active corrosion inhibitor substance (B1) used in accordance with the invention, furthermore, also ensures particularly uniform distribution of the oil on the metal surface. Moreover, the active substance exhibits strong IR absorptions, particularly the >P═O band, and so the application of the oil can be controlled and monitored to particularly good effect by means of IR spectroscopy.

Step (2) of the Method

In step (2) of the method the oiled, galvanized steel strip is transported to a fabrication site for shaped articles. Fabrication sites for shaped articles are, for example, pressing plants, in which automobile bodies and/or parts of automobile bodies are produced.

For the purpose of transport, the galvanized steel strips are commonly rolled up to form coils. The transport in question is preferably transport by truck and/or rail. The steel strips may be transported immediately after step (1) of the method or may first be stored temporarily before being transported.

Step (3) of the Method

At the fabrication site for shaped articles, the oiled, galvanized steel strips are separated and shaped to form articles. Fabrication sites for shaped articles are, for example, pressing plants in which automobile bodies and/or parts of automobile bodies are produced.

In the course of separation, the galvanized, oiled steel strip is separated into appropriately sized pieces, and also, optionally, particles of material are separated from the undivided material for the purpose of further shaping. The separation techniques may be machining techniques or shaping techniques. Separation may be performed, for example, by punching or cutting using appropriate tools. Cutting may also be undertaken thermally, by means of lasers, for example, or else by means of sharp jets of water. Examples of further separating techniques comprise techniques such as sawing, drilling, milling or filing. The cutting of the metal strip is sometimes also referred to as slitting.

In the forming process, shaped articles are produced, from the individual metal sheets obtained at separation, by means of plastic alteration in shape. The forming operation may be a cold or hot forming process. Preferably it is a cold forming process. Forming may, for example, involve compressive forming, such as rolling or embossing, tensile compressive forming, such as cold-drawing, deep-drawing, roll-bending or press-bending, tensile forming such as lengthening or widening, flexural forming such as bending, edge-rolling or edging, and shearing forming such as twisting or dislocating. Details concerning such forming techniques are known to the skilled worker. The operations are also recorded, for example, in the form of relevant standards, such as DIN 8580 or DIN 8584, for example. One method particularly preferred for implementing the present invention is that of deep-drawing.

In one embodiment of the invention the corrosion preventive oil applied in step (1) of the method remains on the surface and functions also as a lubricant for forming.

In another embodiment of the method, the individual sheets can also first be cleaned after having been separated. This cleaning may be performed, for example, by rinsing with water. After rinsing with water, the sheets may be squeezed off. Subsequently the corrosion preventive used in accordance with the invention, and/or forming oil, may be applied in an amount of 0.5 to 50 g/m$^2$.

The resulting shaped articles can be subjected to further processing in further method steps in the same manufacturing site, by means of cleaning, application of a permanent corrosion protective, and coating, for example, optionally also after joining to form assembled shaped articles.

Step (4) of the Method

In one preferred embodiment of the method, the shaped articles obtained in step (3), examples being parts of automobile bodies, are transported in a further step (4) of the method to a further fabrication site, an automobile assembly facility, for example. The transport in question may preferably be by truck or by rail. The shaped articles may be transported immediately after step (3) of the method, or may first be stored temporarily before being transported. At the further fabrication site, the shaped articles obtained in step (3) are subjected to further processing.

Step (5) of the Method

In the preferred embodiment of the method, the further processing comprises at least one step (5) of the method, in which the shaped articles obtained in step (3) are joined to other shaped articles to form assembled shaped articles. This can be done, for example, by pressing, welding, soldering, adhesive bonding, screwing or riveting. For example, an automobile body may be assembled from a plurality of individual parts. Joining may be carried out using two or more identical or different shaped parts obtained in step (3), or else different kinds of shaped articles may be employed. For example, shaped articles made from galvanized steel, ungalvanized steel, and aluminum may be combined with one another to form an assembled shaped article.

The assembled shaped articles made from galvanized steel can subsequently be processed further in a conventional way to form the intermediate products or end products, as for example by cleaning, phosphating, and the application of various paint coats.

Shaped Articles

In a further aspect, the invention provides shaped articles made from single-sidedly or double-sidedly galvanized steel sheet which comprise a film of a corrosion preventive oil applied to the galvanized surface in an amount of 0.25 to 5 g/m$^2$, the composition of the corrosion preventive oil being that already described above. Preferred compositions and preferred film thicknesses are the values already stated. Examples of such shaped articles have likewise been given above. The shaped articles may also be metal panels or laser-welded circuit boards. Preferably they are automobile bodies or parts of automobile bodies.

The shaped articles may be produced preferably by the method of the invention. In principle, however, their production may also take place by other methods. Thus, for example, the corrosion protection of the steel strips and/or the corrosion protection in the course of separating and of forming to give the shaped articles may be ensured, for example, by means of other methods, in other words using, for example, different corrosion inhibitors, and the corrosion preventive oil used in accordance with the invention may only be applied after the shaped article has been produced. In this way the shaped article can be protected for transport. Application may take place, for example, by spraying.

Use of a Corrosion Preventive Oil

In a further aspect the invention provides for the use of a corrosion preventive oil for corrosion protection in the course of the storage and transport of shaped articles made from galvanized steel sheet, by application of the oil in an amount of 0.25 to 5 g/m$^2$ to the surface of the shaped article, the composition of the corrosion preventive oil being that already described above, and preferred compositions, preferred film thicknesses, and examples of shaped articles having already been given above. The shaped articles may also be metal strips, especially rolled metal strips, metal panels or laser-welded circuit boards. Preferably they are automobile bodies or parts of automobile bodies. The oil may be applied by means of various techniques, such as by spraying, for example.

Advantages of the Invention

Through the use of the above-described corrosion preventive oil featuring the active corrosion inhibitor substances (B1) it is possible to avoid the occurrence of black-spot corrosion in a particularly effective way, or at least to significantly reduce it. Furthermore, the inventively used corrosion preventive oil assists the forming operation, more particularly the deep-drawing, slitting and roll forming, by means of an excellent lubricating performance. Moreover, the shaped articles coated in accordance with the invention can be readily adhesively bonded without the corrosion preventive oil hindering the bonding operation, and, finally, the shaped articles can be cleaned and phosphated without the phosphating being adversely affected in terms of phosphate coat weight, coat homogeneity or crystal size.

The examples below are intended to illustrate the invention.

Corrosion Preventive Formulation Used:

For the experiments, a phosphoric acid polyoxyalkylene ester was prepared starting from polypropylene glycol and polyphosphoric acid in accordance with the procedure described by DE 27 56 747 A1, example 2 (n about 34). The experiments were carried out using a 35% mixture of the resultant phosphoric acid polyoxyalkylene ester with dipropylene glycol.

For comparative experiments, a commercially customary alkylphosphoric ester ($C_{16}/C_{18}$ alkylphosphoric ester) was used as corrosion preventive oil. It was used without diluent.

Furthermore, for comparison purposes, a commercial white oil for corrosion inhibition is used, having the following properties:

Boiling point: >300° C.

Density at 15° C.: 0.887 kg/l

Viscosity at 20° C. (measured to ASTM D 445): 145 $mm^2/s$

Viscosity at 40° C. (measured to ASTM D 445): 36 $mm^2/s$

Flash point (measured to ASTM D 92): 214° C.

Pour point (measured to ASTM D 97): 3° C.

Coating and Testing of the Metal Sheets:

With the formulations described or the white oil, test sheets of galvanized steel (10 cm×15 cm) were coated in a quantity of 1.5 $g/m^2$. For this purpose the test sheet was placed on a precision balance, and the formulation was applied in the quantity stated to the surface of the sheet using a precision syringe. The amount applied was subsequently distributed over the metal surface by means of a rubber roller having a smooth surface and a Shore A hardness of 50, with forceful pressing.

Black Spot Test:

The sheets treated in this way are sprinkled with salt grains (NaCl) having a size of about 0.1 to 1 mm. The density per unit area is approximately 25 000 salt grains/$m^2$ (about 250 salt grains/$dm^2$). Subsequently the panels are stored vertically for 96 h in a controlled-climate chamber at 20° C. and 85% humidity, and the formation of rust is monitored photographically. Following storage, the sheets are rinsed and dried and evaluated photographically.

Salt Spray Test

Additionally, for purposes of comparison, a conventional salt spray test in accordance with DIN EN ISO 7253 was carried out using the metal sheets—in other words, the entire metal surface was exposed uniformly to a fine salt mist in a test chamber.

Discussion of the Results

In the salt spray tests, the phosphoric polyoxyalkylene esters used in accordance with the invention, like the alkyl phosphoric esters used for comparative purposes, gave an average corrosion protection effect which was about the same.

In the "black spot test", in contrast, there are very marked differences apparent between the metal sheet coated with alkylphosphoric esters or with a conventional corrosion preventive oil, and the phosphoric polyoxyalkylene esters used in accordance with the invention.

Figure 1:
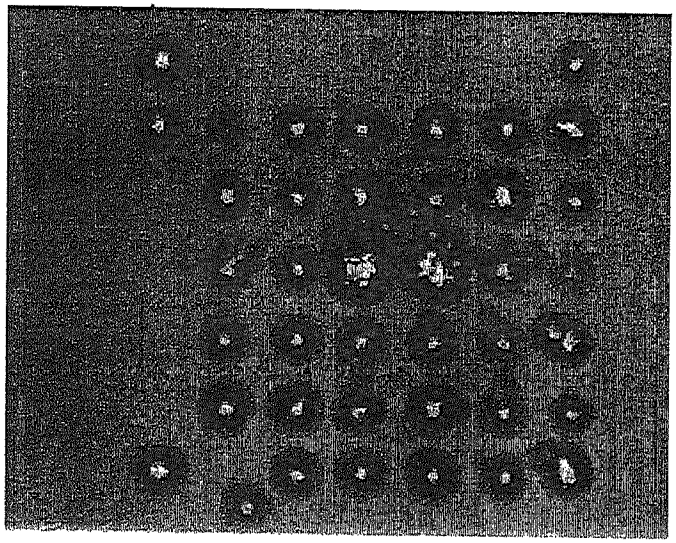
FIG. 1 shows the comparative experiment in which a conventional white oil is used as corrosion preventive oil, after experimental duration of 24 hours.

FIG. 1 shows the comparative experiment in which a conventional white oil is used as corrosion preventive oil, after an experimental duration of 24 hours. After the 24 hours, a significant number of black spots are visible.

FIG. 2, in contrast, shows a photograph of the metal sheet coated with the corrosion preventive oil of the invention, after an experimental duration of 96 hours. Here there are only a few, relatively small, black spots visible even after 96 hours.

Figure 3:
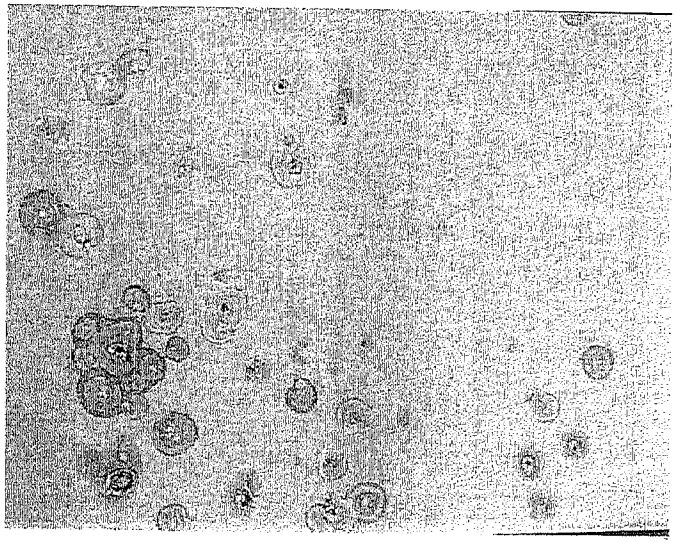
FIG. 3 shows a photograph of the metal sheet coated, for purposes of comparison, with a commercially customary alkylphosphoric ester, after an experimental duration of 96 hours.

FIG. 3 shows a photograph of the metal sheet coated, for purposes of comparison, with a commercially customary alkylphosphoric ester, after an experimental duration of 96 hours. On this sheet as well there is already a marked number of black spots visible.

The inventive and comparative examples show the particular suitability of the phosphoric polyoxyalkylene esters used in accordance with the invention for corrosion prevention in transport, for which black spot corrosion is the major corrosion phenomenon. The alkylphosphoric esters known as corrosion inhibitors exhibit virtually no effect in this application.

The invention claimed is:

1. A method comprising producing shaped articles made from galvanized steel by a process comprising—in order—:

(1) applying a corrosion preventive oil to a surface of a galvanized steel strip in an amount of 0.25 to 5 $g/m^2$, (2) transporting the oiled, galvanized steel strip to a fabrication site for shaped articles, and (3) separating and forming the oiled, galvanized steel strip into shaped articles, wherein the corrosion preventive oil comprises 20 to 100% by weight, based on the total amount of all of the components of the corrosion preventive oil, of at least one phosphoric ester (A) of the general formula $$[R^2—(—O—CH(R^1)—CH_2—)_n—O—]_k—P(=O)—(OX)_{3-k}$$

and where $R^1$, $R^2$, X, n, and k have the following definitions:

k: 1 or 2, n: a number from 10 to 70, $R^1$: independently at each occurrence a radical selected from the group consisting of H, $C_1$ to $C_{10}$ alkyl radicals or aryl-substituted $C_2$ to $C_{10}$ alkyl radicals, wherein for at least 50 mol % of the radicals $R^1$ is a methyl radical, $R^2$: H or a $C_1$ to $C_{30}$ alkyl radical, X: H or a cation $^1/mY^{m+}$, where m is a natural number from 1 to 3.

2. The method according to claim 1, further comprising:

(4) transporting the shaped articles to a further fabrication site.

3. The method according to claim 2, further comprising:

(5) joining the shaped articles to other shaped articles to form assembled shaped articles.

4. The method according to claim 1, wherein the shaped articles produced in step (3) are parts of automobile bodies.

5. The method according to claim 3, wherein the assembled shaped articles produced in step (5) are automobile bodies.

6. The method according to claim 1, wherein, in step (3), the metal strip into individual sheets and cleaned and, prior to forming, a second corrosion preventive oil comprising 20 to 100% by weight, based on the total amount of all of the components of the corrosion preventive oil, of at least one phosphoric ester (A) of the general formula $$[R^2—(—O—CH(R^1)—CH_2—)_n—O—]_k—P(=O)—(OX)_{3-k}$$

is applied in an amount of 0.25 to 3 g/m$^2$.

7. The method according to claim 1, wherein the transport of step (2) is transport by truck or by rail.

8. The method according to claim 1, wherein the corrosion preventive oil further comprises 20 to 80% by weight of at least one diluent (B).

9. The method according to claim 8, wherein the at least one diluent comprises $R^3—(—O—CH(CH_3)—CH_2—)_m—O—R^3$, where $R^3$ independently of one another are H or a $C_1$ to $C_4$ alkyl radical and m is a number from 2 to 20.

10. The method according to claim 8, wherein the at least one diluent comprises dipropylene glycol.

* * * * *